United States Patent [19]

Löbig

[11] Patent Number: 4,836,159

[45] Date of Patent: Jun. 6, 1989

[54] ENGINE CRANKSHAFT SUPPORTS

[75] Inventor: Arnold Löbig, Ruesselsheim, Fed. Rep. of Germany

[73] Assignee: General Motors Corporation, Detroit, Mich.

[21] Appl. No.: 242,932

[22] Filed: Sep. 9, 1988

[30] Foreign Application Priority Data

Sep. 15, 1987 [DE] Fed. Rep. of Germany ..... 3730925

[51] Int. Cl.[4] ..... F02F 7/00

[52] U.S. Cl. ..... 123/195 H; 384/429

[58] Field of Search ..... 123/195 R, 195 A, 195 S, 123/195 H, 195 C, 198 E; 384/429

[56] References Cited

U.S. PATENT DOCUMENTS

| | | | |
|---|---|---|---|
| 2,019,558 | 11/1935 | Brush | 123/195 H |
| 2,287,399 | 6/1942 | Ware et al. | 123/195 H |
| 3,464,746 | 9/1969 | Weber | 123/195 R |
| 3,782,792 | 1/1974 | Pfleiderer | 123/195 H |
| 4,189,193 | 2/1980 | Schumacher | 123/195 H |
| 4,520,771 | 6/1985 | Hayashi | 123/195 R |

FOREIGN PATENT DOCUMENTS

| | | | |
|---|---|---|---|
| 0136014 | 6/1986 | Japan | 384/429 |
| 221104 | 9/1924 | United Kingdom | 123/195 H |

*Primary Examiner*—David A. Okonsky
*Attorney, Agent, or Firm*—Robert J. Outland

[57] ABSTRACT

In an internal combustion engine, in the crankcase (2), as shown in FIG. 1, each bearing cap (7) supporting a crankshaft bearing is, in each instance, bolted to its bearing web (4) with only a single screw (8). On the side of the bearing cap (7) opposite the screw (8), there is provided on the bearing web (4) a supporting surface (11), against which the bearing cap (7) abuts, so that some of the forces parallel to the cylinder axis can be conveyed directly into the crankcase (2).

14 Claims, 4 Drawing Sheets

ENGINE CRANKSHAFT SUPPORTS

TECHNICAL FIELD

This invention relates to internal combustion engines and the like in which a crankshaft is supported in bearings, each retained in a bearing web of the engine crankcase and a bearing cap bolted against contact surfaces of the bearing web. Such internal combustion engines are provided in present day motor vehicles and are generally known.

BACKGROUND

In known internal combustion engines, each bearing cap is held against the contact surfaces of its bearing web by means of at least two screws, located on opposite sides of the longitudinal axis of the crankshaft. As an example, U.S. Pat. No. 3,464,746, shows a V-type internal combustion engine having such a crankshaft support arrangement.

The placement of at least two screws per bearing cap requires an expenditure for two through bores in the bearing cover, two corresponding threaded bores in the bearing block, and two screws for each together with the cost of installation of the two screws in each instance. A further cost results from the fact that the high vertical forces which occur when the piston moves downward must be fully absorbed by the bearing cap, so that the latter and its two screws must be very substantial.

The problem on which the invention is based is that of creating an internal combustion engine of the type initially mentioned, such that its crankshaft support is as simply designed as possible and therefore can be produced as economically as possible.

SUMMARY OF THE INVENTION

According to the invention, this problem is solved by providing a supporting surface on the bearing web or engine block at an angle to the cylinder axis, against which a corresponding guide surface of the bearing cap abuts, and providing a screw or stud only on the side of the bearing cap opposite the guide surface and the supporting surface for tightening the bearing cap against the contact surfaces.

By means of this provision, according to the invention, of a supporting surface at an angle, when forces aligned in the direction of the cylinder axis occur, the bearing cap supports itself against the supporting surface. As a result, it is sufficient if only one screw is provided on the opposite side of the bearing cap to tighten the bearing cap against the contact surfaces. The invention reduces the number of screws for the crankshaft bearings by half, regardless of the number of cylinders. This results in lower inventories as a result of fewer parts, and the bearing supports can be lighter and can be assembled in less time. Another result is that, because the screws are located on only one side of the bearing web, the bearing web can be better adapted to the existing conditions in the crankcase.

In one embodiment of the invention, the single screw is guided through a through bore in the bearing cap into a threaded hole in the bearing web. A favorable force distribution results when the screw extends parallel to the cylinder axis, the contact surfaces extend at an angle $\alpha$ of approximately 45 degrees to the screw and therefore also to the cylinder axis, and the supporting surface is positioned perpendicular to the contact surfaces.

In another embodiment of the invention, the screw is screwed into a threaded bore perpendicular to the cylinder axis provided in the engine block, and its end abuts against the bearing cap such that the latter is simultaneously pressed against the contact surfaces and the supporting surface. By means of this configuration, a crankshaft bearing support can be bolted together from the outside, the bearing force is carried into the highly rigid structure of the crankcase, and no components project below the flange of the engine block and bearing web.

Favorable force distribution results with the embodiment with a screw pressing against the bearing cap, if the bearing cap has a contact pressure surface aligned parallel to the cylinder axis.

The force of the screw which presses the bearing cover against the contact surfaces and simultaneously against the supporting surface can be defined particularly accurately if the screw has at its end face a conical tip, and if the contact pressure surface has a corresponding conical recess.

The bearing cap could have, in cross section, approximately the shape of a right triangle. Further economy of material is achieved if the screw abutment surface is formed by the end face of a projection provided on the bearing cap.

The contact pressure surface and contact surfaces can be particularly easily produced by milling of a countersurface is provided on the side of the bearing web opposite the supporting surface, extending parallel to the supporting surface and, like the latter, extending rectilinearly from below into the crankcase. With this configuration, an end mill can be introduced rectilinearly from below into the crankcase, to mill the required surfaces.

The bearing cap can be retained in a guide similar to a swallow-tail, so that it is securely centered and can withstand even high lateral forces, if, according to another embodiment of the invention, the screw is guided by a clamping wedge which, on one hand, abuts against a surface leading into the crankcase and extending parallel to the longitudinal axis of the screw, and on the other hand, abuts by means of a clamping surface extending at an angle thereto against a corresponding surface on the bearing cap. This clamping wedge makes it possible to insert the bearing cap into the bearing web from below, despite the presence of the swallow-tail guide.

The screw can be made equivalent to the clamping wedge in terms of function, thus saving one component, if a conical segment thereof abuts against a surface of the crankcase or web and simultaneously against a clamping surface of the bearing cap.

The bearing web is especially easy to machine if the longitudinal axis of the screw extends parallel to the axis of the bearing block.

An associated solution to the problem initially posed, in which again only one screw is required for one bearing cap, is found in an embodiment wherein the bearing cap has, on its side opposite the contact surfaces for the bearing web, a contact pressure surface against which abuts a clamping wedge to be tightened against the contact pressure surface by means of a tensioning screw.

Such an embodiment is particularly easy to configure if the tensioning screw passes through the clamping wedge, is retained on both sides of the bearing cover in a fitting bore in the crankcase and has in the intervening region an external thread by means of which it is screwed into a corresponding internal thread in the clamping wedge.

With this embodiment as well, the crankcase can be easily configured by providing each of the fitting bores for the tensioning screws in webs of the crankcase, which are arranged in pairs opposite one another on either side.

BRIEF DRAWING DESCRIPTION

The invention allows for a number of embodiments. To illustrate further its basic principle, six such embodiments are illustrated in the drawings and will be described below.

DETAILED DESCRIPTION

Figure 1:
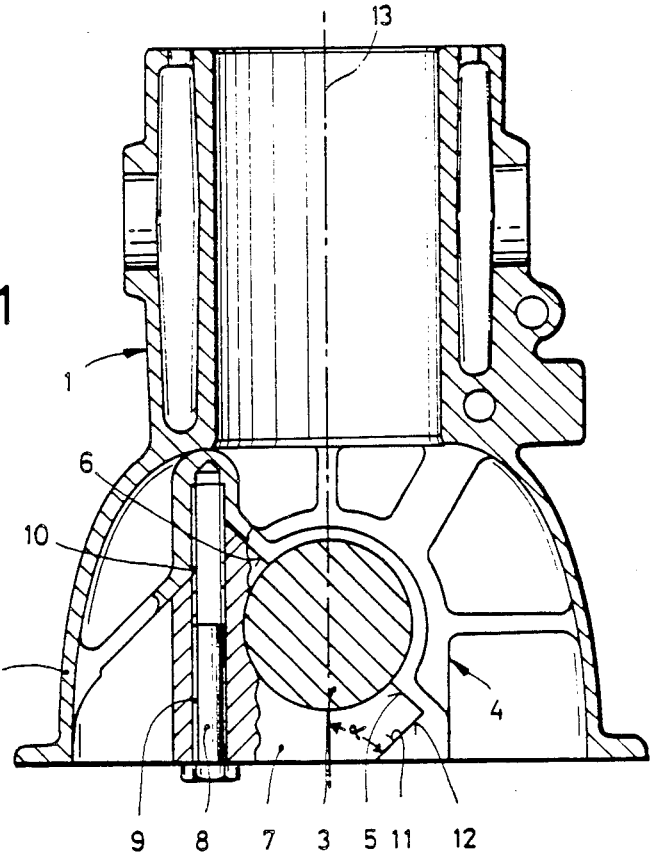
FIG. 1 is a vertical section through a cylinder block of an internal combustion engine according to the invention, with crankcase and crankshaft support bearing.

FIG. 1 shows a cylinder block 1 with a crankcase 2, in which a crankshaft 3 is mounted. For this purpose, there is provided in the crankcase 2 a bearing web 4 with two contact surfaces 5, 6, extending at an angle, against which a bearing cap 7 is clamped with only a single screw 8. This screw 8 extends through bore 9 in the bearing cap 7 into engagement with a threaded bore 10 in the bearing web 4. Provided on the side of the bearing web 4 opposite the screw 8, at right angles to the plane of the contact surfaces 5, 6, is a supporting surface 11, against which a corresponding guide surface 12 of the bearing cap 7 abuts.

In FIG. 1, numeral 13 indicates the cylinder axis. The supporting surface 11 extends at an angle $\alpha$ of 45 degrees to this cylinder axis 13. In addition, the plane of the contact surfaces 5, and 6, lies perpendicular to the plane of the supporting surface 11 and, thus, at the angle $\alpha$ of 45 degrees to the cylinder axis 13. As a result of this configuration, vertical forces, i.e., forces acting in the direction of the cylinder axis 13, are partly transmitted by means of the supporting surface 11 into the bearing web. Therefore, the one screw 8 on the side opposite the supporting surface 11 is sufficient to secure the bearing cap 7.

Figure 2:
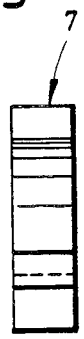
FIG. 2 is an edge view of a bearing cap of the crankshaft support.
Figure 3:
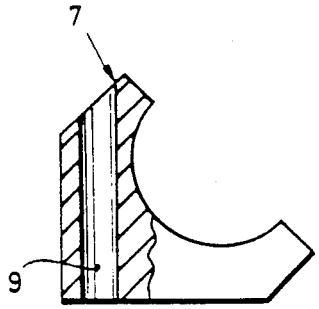
FIG. 3 is a side view of the bearing cap of FIG. 2.

FIGS. 2 and 3 illustrate the configuration of the bearing cap 7. Note that the latter, when seen from the edge, is approximately rectangular, and that the through bore 9 runs through one of the legs.

Figure 4:
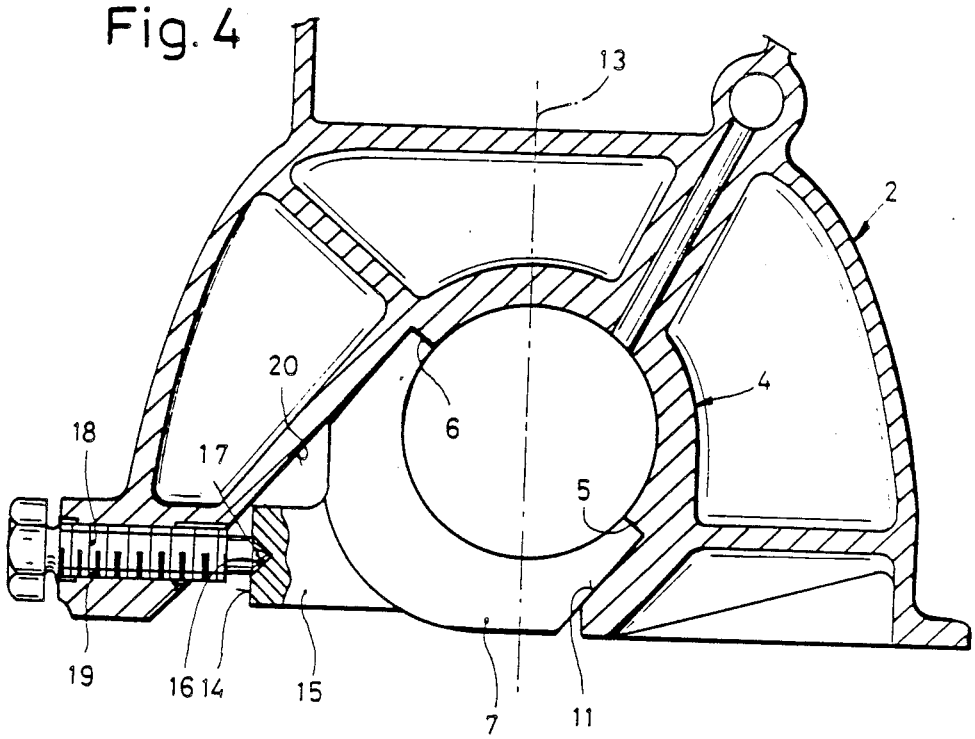
FIG. 4, is a section, as in FIG. 1, through a second embodiment of an internal combustion engine according to the invention.

FIG. 4 shows an embodiment of an internal combustion engine that is different from FIG. 1. In this embodiment, the bearing cap 7 has, instead of a through bore 9, a contact pressure surface 14 which is formed by the end face of a projection 15 provided on the bearing cap 7 at right angles to the cylinder axis 13. Provided in this contact pressure surface 14 is a conical recess 16, which a conical tip 17 of a screw 18 engages. The screw 18 engages a threaded bore 19 at the edge of web 4 in the crankcase 2, also aligned at right angles to the cylinder axis 13. As a result, the screw 18 can press the bearing cap 7 against the supporting surface 11, configured in accordance with the embodiment of FIG. 1, and simultaneously against the contact surfaces 5, 6, also corresponding to FIG. 1. FIG. 4 further indicates that the bearing web 4 has, on the side opposite the supporting surface 11, a counter-surface 20, which extends parallel to the supporting surface 11 from below directly into the crankcase 2. As a result, to produce the contact surfaces 5, 6, an end mill can be introduced from below directly into the crankcase 2.

Figure 5:
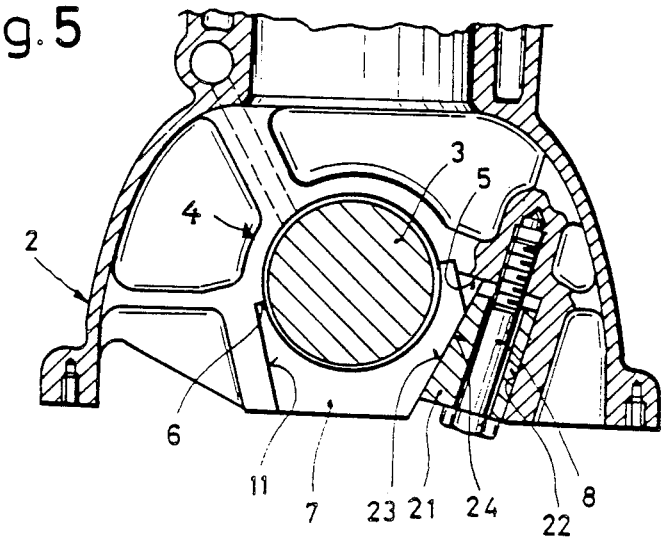
FIG. 5 is a section, as in FIG. 1, through a third embodiment of an internal combustion engine according to the invention.

The embodiment of FIG. 5 differs from that of FIG. 1 primarily in that the screw 8 is guided, not through the bearing cap 7, but through a clamping wedge 21. The wedge 21 abuts against a surface 22 leading at an angle into the crankcase 2, parallel to the longitudinal axis of the screw 8. Simultaneously, by means of a clamping surface 23 extending at an angle to surface 22, the wedge abuts against a corresponding surface 24 of the bearing cap 7. The oppositely angled surfaces 11, 22, form a swallow-tail like recess in the bearing web 4. When the screw 8 is tightened, the bearing cap 7 is clamped against the supporting surface 11 and simultaneously against the contact surfaces 5, 6. As long as the clamping wedge 21 is not installed, the bearing cap 7 can be inserted into the crankcase bearing web 4 from below in spite of the swallow-tail configuration.

Figure 6:
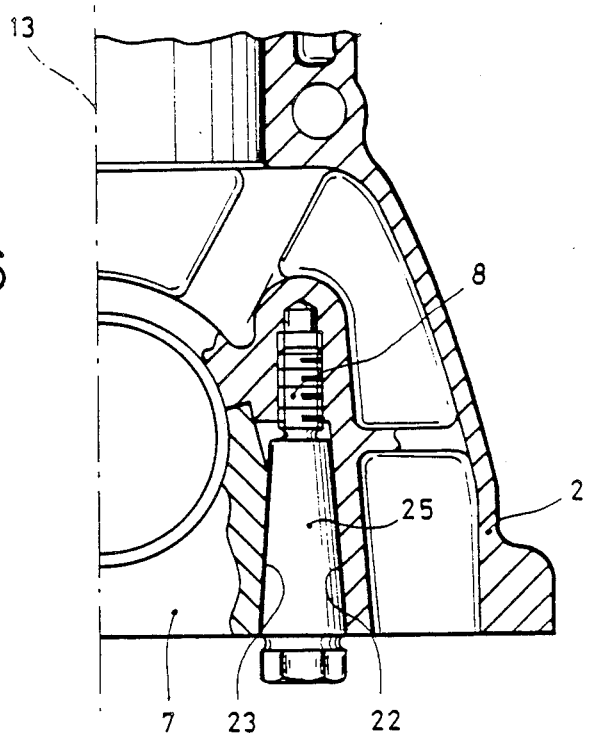
FIG. 6 is a section, as in FIG. 1, through a fourth embodiment of an internal combustion engine according to the invention.

In FIG. 6, the screw 8 has a conical section 25, through which it abuts simultaneously against the bearing cap 7 and the surface 22 of the crankcase 2. As a result, with this embodiment, the clamping wedge 21 shown in FIG. 5 is not required. The screw 8 simultaneously constitutes the clamping wedge.

Figure 7:
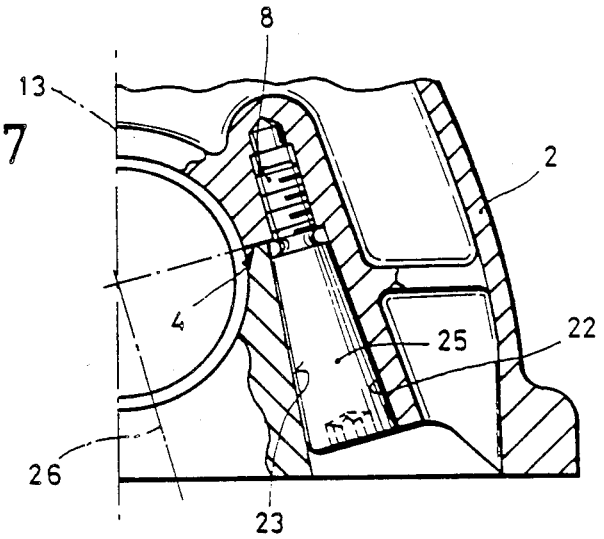
FIG. 7 is a section, as in FIG. 1, through a fifth embodiment of an internal combustion engine according to the invention.

The embodiment of FIG. 7 differs from the one in FIG. 6 primarily in that the screw 8 does not extend parallel to the cylinder axis 13, but rather parallel to the axis 26 of the bearing web 4. As a result, the bearing web is easier to machine. In addition, the screw 8 is one with a polygonal socket. It therefore has no head projecting downward from the crankcase 2.

Figure 8:
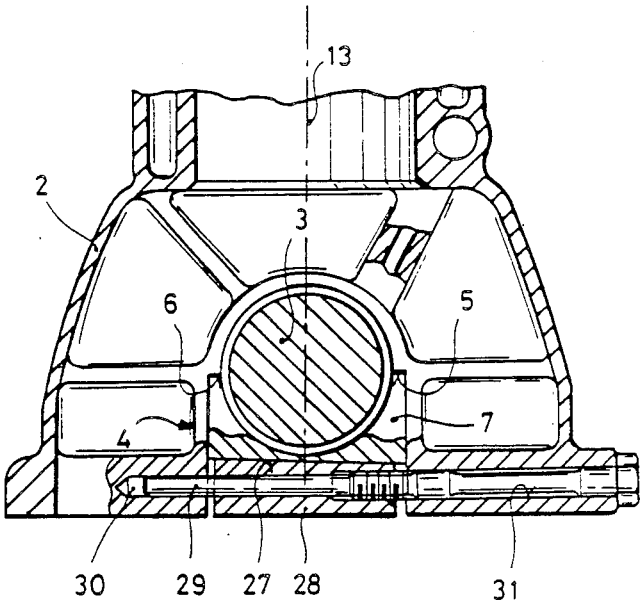
FIG. 8 is a section, as in FIG. 1, through a sixth embodiment of an internal combustion engine according to the invention.

In the embodiment of FIGS. 8 through 11, the bearing cap 7, as FIG. 8 shows, abuts against the contact surfaces 5, 6 of the bearing web 4, which are aligned precisely perpendicular to the cylinder axis 13. On its side opposite the contact surfaces 5, 6, the bearing cap 7 has a contact pressure surface 27 which extends at an angle to the contact surfaces 5, 6 and against which a clamping wedge 28 abuts. This clamping wedge 28 is retained and clamped against the contact pressure surface 27 by a tensioning screw 29 which passes through the wedge 28 and is retained and sits on either side of the bearing cap 7 in fitting bores 30, 31 in the crankcase 2.

Figure 9:
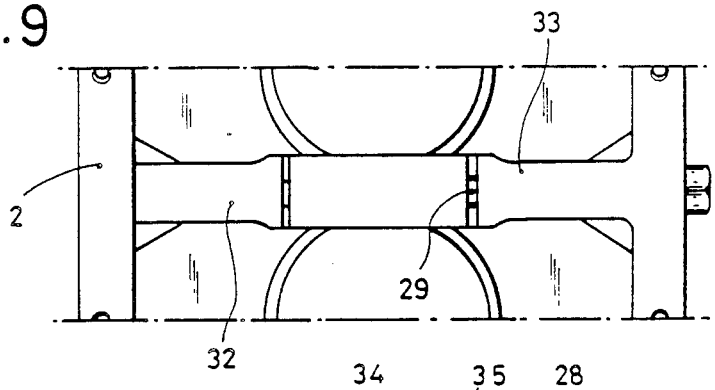
FIG. 9 is a lower plan view of the arrangement of FIG. 8.

FIG. 9 shows that the crankcase 2 has, for each tensioning screw 29, two oppositely oriented web portions 32, 33, in which the fitting bores 30, 31 illustrated in FIG. 8 are provided, aligned with one another.

Figure 10:
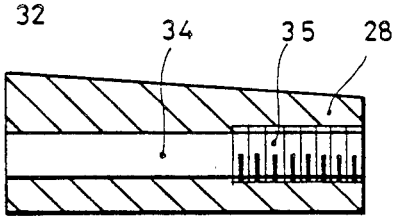
FIG. 10 is a longitudinal section through a clamping wedge of the arrangement of FIGS. 8 and 9.
Figure 11:
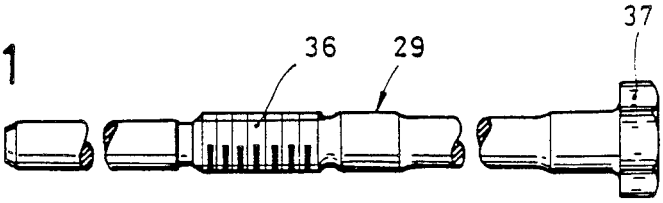
FIG. 11 is a side view of a tensioning screw of the arrangement of FIGS. 8 and 9.

In FIG. 10, a through bore 34 is shown in the clamping wedge 28, having an internal thread 35 in the part on the right-hand side of the drawing. FIG. 11 shows that the tensioning screw 29 has a corresponding external thread 36, by means of which it is screwed into this internal thread 35. If the head 37 of the tensioning screw 29 is turned, the clamping wedge 28 is shifted perpendicular to the cylinder axis 13, and, depending on the direction of rotation, clamps the bearing cap 7 to a greater or lesser degree against the contact surfaces 5, 6.

The embodiments of the invention in which an exclusive property or privilege is claimed are defined as follows:

1. An internal combustion engine with a crankshaft bearing support comprising bearing web and a bearing cap bolted onto contact surfaces of the bearing web, characterized in that at an angle to the cylinder axis (13) on the bearing web (4) is provided a supporting surface (11) against which the bearing cap (7) abuts by a corresponding guide surface (12) and only on the side of the bearing cap (7) opposite the guide surface (12) and the supporting surface (11) there is provided a screw (8) for securing the bearing cap (7) against the contact surfaces (5, 6).

2. An internal combustion engine according to claim 1, characterized in that the screw (8) extends through a through bore (9) of the bearing cap (7) into a threaded bore (10) of the bearing web (4).

3. An internal combustion engine according to claim 2, characterized in that the screw (8) extends parallel to the cylinder axis (13), the contact surfaces (5, 6) extend at an angle $\alpha$ of preferably 45 degrees to the screw (8) and hence also to the cylinder axis (13), and the supporting surface (11) is disposed at right angles to the contact surfaces (5, 6).

4. An internal combustion engine according to claim 1, characterized in that the screw (18) is screwed into a threaded bore (19) provided in the bearing web (4) perpendicularly to the cylinder axis (13) and abuts by its end against the bearing cap (7) such that the latter is simultaneously pressed against the contact surfaces (5, 6) and the supporting surface (11).

5. An internal combustion engine according to claim 4, characterized in that the bearing cap (7) has a contact pressure surface (14) against which the screw (18) abuts and which is disposed parallel to the cylinder axis (13).

6. An internal combustion engine according to claim 5, characterized in that the screw (18) comprises at its end face a conical tip (17), and the contact pressure surface (14) comprises a corresponding conical recess (16).

7. An internal combustion engine according to claim 6, characterized in that the contact pressure surface (14) is formed by the end face of a projection (15) provided on the bearing cap (7).

8. An internal combustion engine according to claim 4, characterized in that on the side of the bearing cap (7) opposite the supporting surface (11) is provided in the web (4) a counter-surface (20) which extends parallel to the supporting surface (11) and, like the latter, extends rectilinearly from below into the crankcase (2).

9. An internal combustion engine according to claim 1, characterized in that the screw (8) is guided by a clamping wedge (21) which, on the one hand, abuts against a surface (22) leading into the crankcase (2) and extending parallel to the longitudinal axis of the screw (8), and on the other hand, abuts by a clamping surface (23), which extends at an angle to the surface (22), against a corresponding surface (24) of the bearing cap (7).

10. An internal combustion engine according to claim 1, characterized in that the screw (8) abuts by a cone section (25) against a surface (22) of the crankcase (2) and simultaneously against a clamping surface (23) of the bearing cap (7).

11. An internal combustion engine according to claim 10, characterized in that the longitudinal axis of the screw (8) extends parallel to the axis (26) of the bearing web (4).

12. An internal combustion engine with a crankshaft bearing support comprising a bearing web (4) and a bearing cap (7) bolted onto contact surfaces of the bearing web (4), characterized in that the bearing cap (7) has, on its side opposite the contact surfaces (5, 6) of the bearing web (4), a contact pressure surface (27) against which abuts a clamping wedge (28) to be tightened against the contact pressure surface (27) by means of a tensioning screw (29).

13. An internal combustion engine according to claim 12, characterized in that the tensioning screw (29) passes through the clamping wedge (28), is retained on both sides of the bearing cap (7) in fitting bores (30, 31) of the crankcase (2), and, in the region between both sides, has an external thread (36) by which it is screwed into a corresponding internal thread (35) of the clamping wedge (28).

14. An internal combustion engine according to claim 13, characterized in that the fitting bores (30, 31) for the tensioning screw (29) are provided in web portions (32, 33) of the crankcase (2) which are arranged in a pair opposite one another from opposite sides.

* * * * *